United States Patent [19]

Chapman, Jr.

[11] 4,330,093

[45] May 18, 1982

[54] THUMB-CONTROLLED HAND-HELD TOOL

[75] Inventor: Ivan B. Chapman, Jr., Baltimore, Md.

[73] Assignee: Western Electric Company, Inc., New York, N.Y.

[21] Appl. No.: 176,610

[22] Filed: Aug. 8, 1980

[51] Int. Cl.[3] ..... B21F 3/04

[52] U.S. Cl. ..... 242/7.17; 140/124; 173/169; D8/68

[58] Field of Search ..... 140/119, 122, 124; 173/169; 242/7.17, 7.18; 81/177 R, 428 PG, 465, 466; D8/68

[56] References Cited

U.S. PATENT DOCUMENTS 3,656,218 4/1972 Staiger ..... 140/124 X
3,949,944 4/1976 Bent ..... 140/124 X

OTHER PUBLICATIONS

Western Electric *Technical Digest,* Issue 30, Western Electric Co. Inc., Apr. 1973, p. 19.
"The Human Factor", *WE Magazine,* Feb.–Mar., 1976, p. 24

*Primary Examiner*—Gil Weidenfeld
*Assistant Examiner*—Fred A. Silverberg
*Attorney, Agent, or Firm*—E. W. Somers

[57] ABSTRACT

In the wire-wrapping of terminals which extend from a terminal block, an operator uses a hand tool which includes a housing having a bit that wraps a wire-like conductor about each terminal, and a handle which allows the tool to be held in a modified prehensile manner. The handle is configured to include a laterally disposed thumb rest which is effective to support the thumb in a relaxed position. The surface of the rest which supports the thumb includes a port which is covered and uncovered repetitively by relatively slight movements of portions of the thumb to control the operation of a fluidic circuit to turn the bit and cause the conductor to be about the terminal. This arrangement results in a substantial reduction in the movement of particular joints of the thumb and of particular muscles which control the movement of the thumb so that worker fatigue is substantially reduced.

5 Claims, 7 Drawing Figures

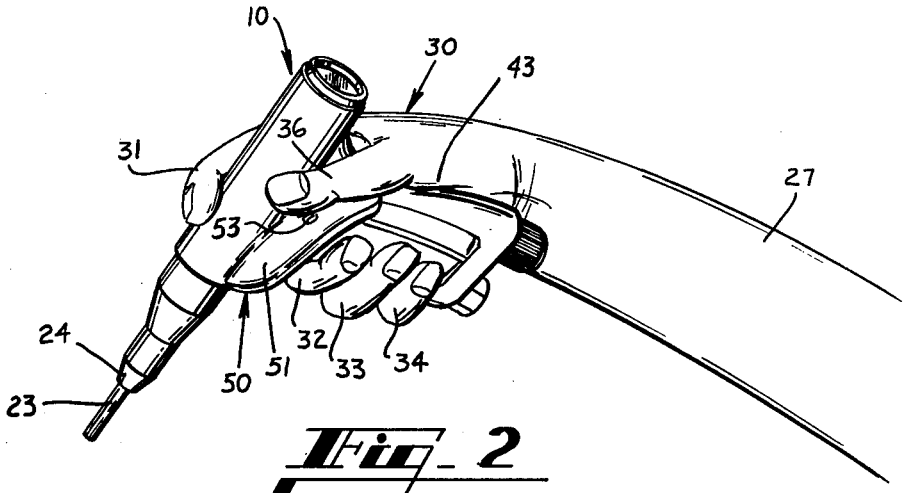
Fig. 2
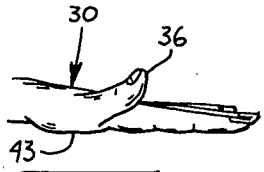
Fig. 3B
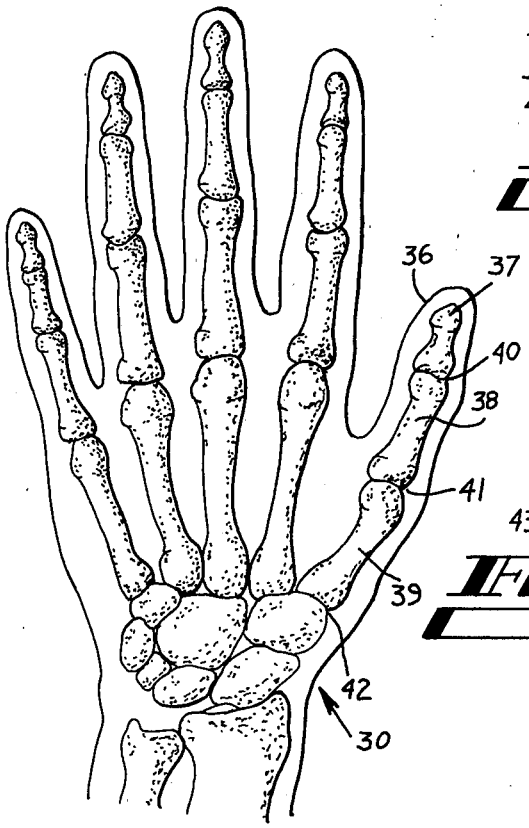
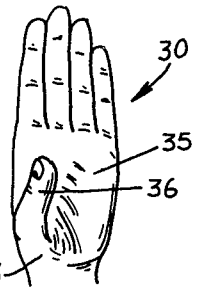
Fig. 3A
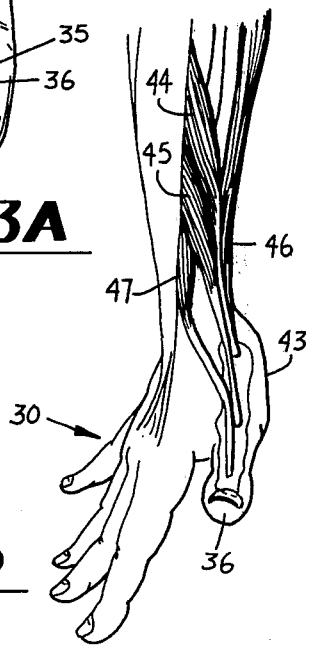
Fig. 4
Fig. 5

THUMB-CONTROLLED HAND-HELD TOOL

TECHNICAL FIELD

This invention relates to a hand-held tool having a thumb-controlled actuating system and, more particularly to an ergonomically designed tool which is used to wire wrap terminal blocks of the type used in the telecommunications industry.

BACKGROUND OF THE INVENTION

In the telecommunications industry, a commonly used piece of equipment is a terminal block which includes a plastic block having a plurality of metallic terminals mounted therein. Typically, portions of the terminals depend from the plastic block and are adapted to have conductors wrapped thereabout in close-fitting relation to establish an electrical connection.

The wrapping of conductors about these terminals is generally accomplished in a factory environment by an operator who uses a wire-wrapping tool throughout a work shift. The terminal block is generally supported on one of its edges surfaces with the depending portions of the terminals which are to be wrapped facing the tool operator.

The typical wire-wrapping tool which is pneumatically operated resembles a handgun and includes a barrel and a handle. The barrel includes a rotatable wrapping bit, which includes an opening for receiving a terminal to be wrapped, while the handle includes a trigger. The tool is generally hand-held so that the trigger is depressed by the forefinger or middle finger of the holding hand to cause a fluidic circuit to be controlled to operate the bit of the tool to wrap an end portion of a conductor about the terminal over which the bit is placed.

From an ergonomic standpoint, it is best to position the terminal block with the terminals oriented horizontally so that the tool is moved horizontally inwardly and then is withdrawn in each cycle of wrapping. Unfortunately, this orientation of the terminal block is not the best insofar as being able to align the tool with a particular terminal of the mass of terminals which depend from the block.

It has been found that the problem of alignment of tool with the terminals is overcome by supporting the block in an inclined position so that the terminals are inclined upwardly as they extend from the block toward the tool operator. While this orientation of the block overcomes the problem of sighting along the terminals to align the tool, it causes biomechanical problems for the operator. For example, the holding of the wire wrap tool by the operator results in a slight ulnar deviation. In other words, the ulnar bone in the forearm of the tool operator deviates from its normal position which causes a pull and extension on muscles of the forearm. Particularly during the above-described tedious and repetitive process of connecting wires to terminals, this pull and extension may over a period of time result in undue fatigue and in product defects.

The ergonomics of hand-held tools is not new and efforts have been made to overcome the fatigue of this operation by modifying the wire wrapping tool. For example, on page 19 of Issue 30 dated April 1973 of the Western Electric *Technical Digest,* there is shown a hand tool which is operated by sensing means other than a mechanical trigger. When a sensing port becomes blocked such as by the positioning of a tool operator's index finger over the port, a stream of air is diverted within a fluidic circuit which causes an air motor to operate the tool.

This just-described arrangement does not completely overcome the fatigue problem encountered in terminal block wiring. The use of the middle or index finger to depress a trigger requires the application of a force to move the trigger through a distance. This same drawback is present in guns which have been modified to include a small tube which extends along the handle of the gun, for there too, the operator must move the thumb or forefinger through a distance to cover the port to control the fluidic circuit. See page 24 of the February-March 1976 issue of the WE® magazine, WE being a registered trademark of the Western Electric Company.

What is required and what is not known in the prior art is a hand tool which is especially suitable for wrapping terminals with conductors and which is ergonomically designed to avoid problems of operator fatigue.

SUMMARY OF THE INVENTION

The foregoing problems of the prior art have been overcome by a hand-held tool of this invention which is caused to be operated through a fluidic circuit that is controlled by relatively insubstantial movements of portions of a tool-operator's thumb with the thumb being maintained in a substantially natural position relative to the remainder of the hand. The tool comprises a housing which includes a handle and a barrel, having a working portion, and means for operating the working portion. A rest is disposed laterally of and connected to the housing and has a port which opens to a surface of the rest which is adapted to supportively engage a user's thumb. The rest is configured so that the thumb is capable of being moved to cover and to uncover the port in a repetitive manner with insubstantial movements of proximal and distal phalanges of a user's thumb. Means connected to the port and to the means for operating the tool and responsive to the covering and the uncovering of the port cause the operation of the tool and the discontinuation of the operation of the tool.

A wire-wrapping tool of this invention includes a housing which includes a handle portion and a barrel having a wire-wrapping portion, said wire-wrapping portion including an opening for receiving a terminal about which a wire is to be wrapped and means mounted for rotation within said housing for wrapping the wire about the terminal. Means are provided for moving rotatably the wire-wrapping portion to cause a plurality of turns of wire to be wrapped about a terminal which extends into the opening of the wire-wrapping portion of the housing. A laterally disposed rest is attached to one side of the housing, has a configuration such that a user's hand in which said tool is held with a somewhat modified prehensile movement and includes a port that opens to a surface of the rest. The rest is positioned to be engaged by the distal part of the thumb of about ninety-five percent of all tool operators. Further, the surface of the rest is adapted to supportively engage the thumb in a manner which allows the thumb to be moved to cover and to uncover the port with insubstantial movements of proximal and distal phalanges of the thumb.

In operation, the tool operator moves the tool to move the opening of the wire-wrapping portion over a terminal and then move slightly the distal part of the thumb which lies generally in a plane with the palm of the hand to cover or uncover the port. This causes a fluidic circuit to be controlled to cause an air motor to turn the wire-wrapping portion to wrap a plurality of turns of the wire about the terminal.

BRIEF DESCRIPTION OF THE DRAWINGS

Other features of the present invention will be more readily understood from the following detailed description of specific embodiments thereof when read in conjunction with the accompanying drawings, in which:

FIG. 2 is a view of the tool of this invention as held by the hand of a tool operator with the position of the forearm being shown during a wrapping operation;

FIGS. 3A and 3B are plan views of a hand to show the thumb in several positions;

FIG. 4 is a plan view of a hand and shows the arrangement of bones in the hand;

FIG. 5 is a view of the hand and forearm and shows the arrangement of muscles which control particular movements of the thumb.

DETAILED DESCRIPTION

Figure 1:
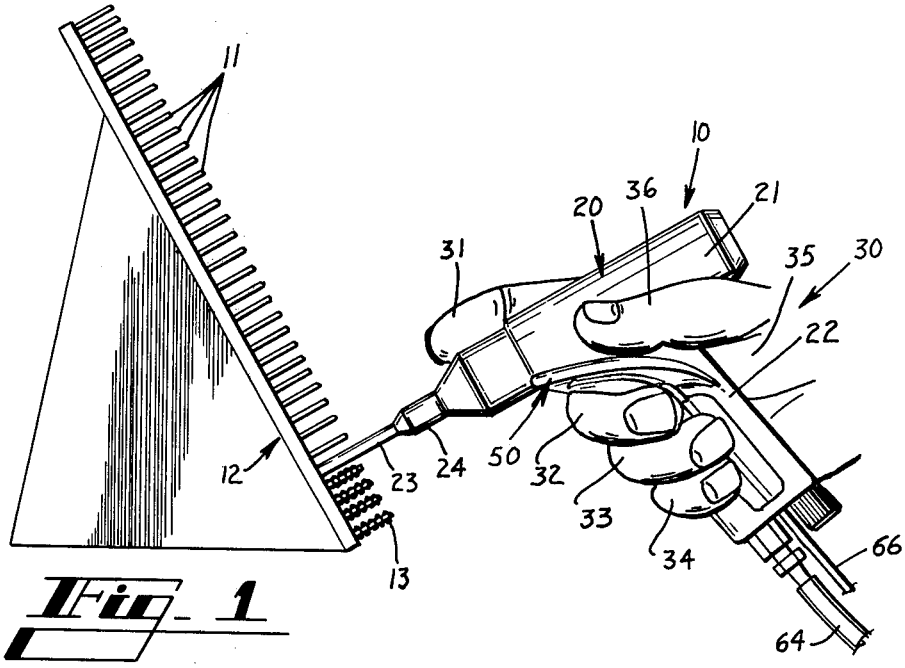
FIG. 1 is a side elevational view of a tool of this invention which is held by an operator in a position in which the tool is being used to wrap turns of a wire-like conductor about a terminal of a terminal block.

Referring now to FIG. 1, there is shown a pistol-grip type hand tool, which is designated generally by the numeral 10, for wrapping a wire-like conductor 13 about each of a plurality of terminals 11—11 of a terminal board 12. Typically, the terminals 11—11 are normal to the plane of the board 12 and the board is supported in an inclined position to allow a tool operator to be able to sight along the terminal pins for purposes of identification.

While the tool 10 of this invention is one for wrapping wire-like conductors about terminals, it should be understood that the invention is not so limited. For example, pistol-grip tools which are used on a repetitive basis in a factory environment may include power screwdrivers or bonding tools.

Pistol-grip hand tools for making wrapped electrical connections between a terminal and a conductor are well known in the art. Typically, a pistol-grip hand tool includes a a handle having a depressible trigger mechanism and a barrel in which is mounted a rotary spindle from which extends a wrapping bit. The handle and the barrel portions of the tool include passages for a motive fluid such as compressed air, which is supplied to an air motor for causing the bit to wrap turns of a conductor about a terminal. Pistol-grip hand tools are shown for example in U.S. Pat. Nos. 3,443,646 and 3,480,119.

As seen in FIG. 1, the tool 10 of this invention includes a housing 20 which resembles a revolver and which includes a barrel portion 21 and a handle portion 22. This barrel portion 21 has a wire-wrapping portion 24 which includes a bit 23 for receiving a terminal pin 11 which is to be wrapped. The bit 23 is mounted rotatably and is adapted to be turned by an air motor (not shown). In order to render the tool 10 capable of being held by a tool operator, the handle 22 is shaped in a fashion similar to those of revolvers. The tool 10 as described thus far is available commercially from the Gardner-Denver Company, for example, under its designation 14YPI which operates at about 4500–4700 rpm.

At the beginning of each wrapping cycle, the tool operator inserts the stripped end of a wire 13 into an offset wire-receiving groove in the peripheral surface of the bit 23. The tool 10 is then advanced toward the terminal board 12 to insert a selected terminal 11 into a terminal-receiving bore of the bit 23. The wire 13 which projects from the groove is bent back toward the tool 10 so that it is anchored in a slot. A conventional tool is energized by depressing a trigger whereupon the motor rotates the bit 23 causing the wire 13 to be drawn out of the groove and wrapped tightly around the terminal 11 in helical convolutions.

As can be imagined from a perusal of the terminal board 12 in FIG. 1., or from personal knowledge of wiring of terminal connections in a factory, the process is repetitive. Wiring often times becomes fatiguing because of the necessity of gripping the tool 10 while manipulating a finger to cyclically depress and release the trigger which is common to conventional pistol-grip hand tools.

Another problem, which was mentioned hereinbefore, occurs because of the disposition of the tool operator and hence the tool relative to the terminal board 12 (see FIG. 2). The tool operator is seated at a work position with the terminal board 12 supported on a workbench directly in front of the seat. In order to allow the tool operator to be able to sight along ones of terminals 11—11 to select correct ones of the terminals for each particular conductor, the board 12 is inclined to a vertical axis. The relative elevations of the board 12 and of the tool operator are such that when the tool 10 is hand-held, the longitudinal axis of the barrel portion 21 is parallel to the terminals 11—11 and is inclined to the horizontal.

The orientation of the tool 10 relative to the board 12 and to the tool operator requires that a forearm 27 (see FIG. 2) of the operator be nonlinear with the axis of its associated hand, which is designated generally by the numeral 30, with the break between the two axes occuring at the wrist. This condition which is referred to as an ulnar deviation adds to the fatigue which is experienced by depressing repetitively a trigger since the muscle activity which is required to operate the trigger would be conducted during the deviation.

Some background in biomechanics and musculoskeletal anatomy is helpful to an understanding of how the tool 10 of this invention avoids these problems of prior art tools. All movements of the hand 30 (see FIG. 1), have been defined as being either prehensile, by which an object such as a tool, for example, is grasped, or non-prehensile by which a tool is manipulated by pushing or lifting. The fundamental requirement of prehension is that the tool be held securely. See J. R. Napier et al "The Prehensile Movements of the Human Hand" *The Journal of Bone and Joint Surgery,* Vol. 38-B, Nov. 1956, pp. 902–908.

A prehensile movement may be characterized as either a power grip or a precision grip. In a power grip, the tool is grasped by partially flexed fingers 31–34 and a palm 35 of the hand 30 with counter pressure being applied by a thumb 36 lying more or less in the plane of the palm. In a precision grip, the tool is held between the fingers 31–34 and the opposing thumb 36. The grip which is used in many hand tools is a type of power grip in which the thumb 36, is fully abducted (see FIG. 3A), that is, there is a forward movement of the thumb at a right angle to the palm 35. For a discussion of abduction movements of the thumb as well as adduction (see FIG. 3B), which is a return movement from abduction, see K. F. Wells *Kinesiology* The Scientific Basis of Human Motion, pp 231–232 5th Edition, W. B. Saunders Co.

Referring now to FIG. 4, it is seen that the thumb 36 comprises a distal phalanx 37, a proximal phalanx 38, and a metacarpal phalanx 39. The distal phalanx 37 is connected to the proximal phalanx 38 through an interphalangeal joint 40, the proximal phalanx to the metacarpal phalanx 39 through a metacarpophalangeal joint 41, and the metacarpal phalanx 39 to the wrist through a carpometacarpal joint 42. The posture of the thumb 36 differs fundamentally in the two grips. In the power grip, it is adducted at both the metacarpophalangeal joint 41 and carpometacarpal joint 42 while in the precision grip, it is abducted at both these joints. During activity, the thumb 36 is always in one or the other of these positions.

An element of precision in the power grip may be accomplished by the posture of the thumb 36. When no precision is required, the thumb 36 becomes wrapped over portion of the middle phalanges of the fingers where it acts purely as a reinforcing mechanism. On the other hand, when some precision is required in a power grip, the thumb 36 becomes adducted so that by small adjustments of posture, it can control the direction in which force is being applied.

As can be seen in FIG. 5, four muscles which cause movement of the thumb are extrinsic and are in the forearm 27, and four intrinsic and are in an area 43 of the hand which is called the thenar eminence. See P. J. Rasch and R. K. Burke *Kinesiology and Applied Anatomy* p. 252 Fourth Edition Lea & Febiger. These extrinsic muscles, particularly an abductor pollicis longus muscle 44 and an extensor pollicis brevis muscle 45, are lengthy ones which extend through the carpal area and are very much active when using the tool 10 in a repetitive fashion. Any reduction in their activity leads to a reduction in worker fatigue. Other muscles which are very active during use of the tool 10 are a flexor pollicis longus muscle 46 and an extensor pollicis longus muscle 47 of the forearm 27.

The tool 10 of this invention allows hand use which tends toward being one characterized as relatively less prehensile than normal and in one which substantially reduces bone joint movement and thumb muscular activity. While it is a power grip of sorts, it is more relaxed than the usual one and eliminates the need to use a trigger which sets up a fatigue condition.

The tool 10 of this invention also overcomes problems which have encountered with the priorly disclosed wire wrapping tool having an externally mounted, relatively small diameter tube on which the thumb 36 was placed to cover or uncover a relatively small opening in the tube. This required repetitive cycles of substantial abduction to cover the opening and of adduction to uncover the port, particularly because the tube caused the thumb 36 to be spaced out from the tool itself. Moreover, this arrangement resulted in a maintenance problem because of the extent of the power grip and of the forces imparted to the relatively flexible tube.

Figure 6:
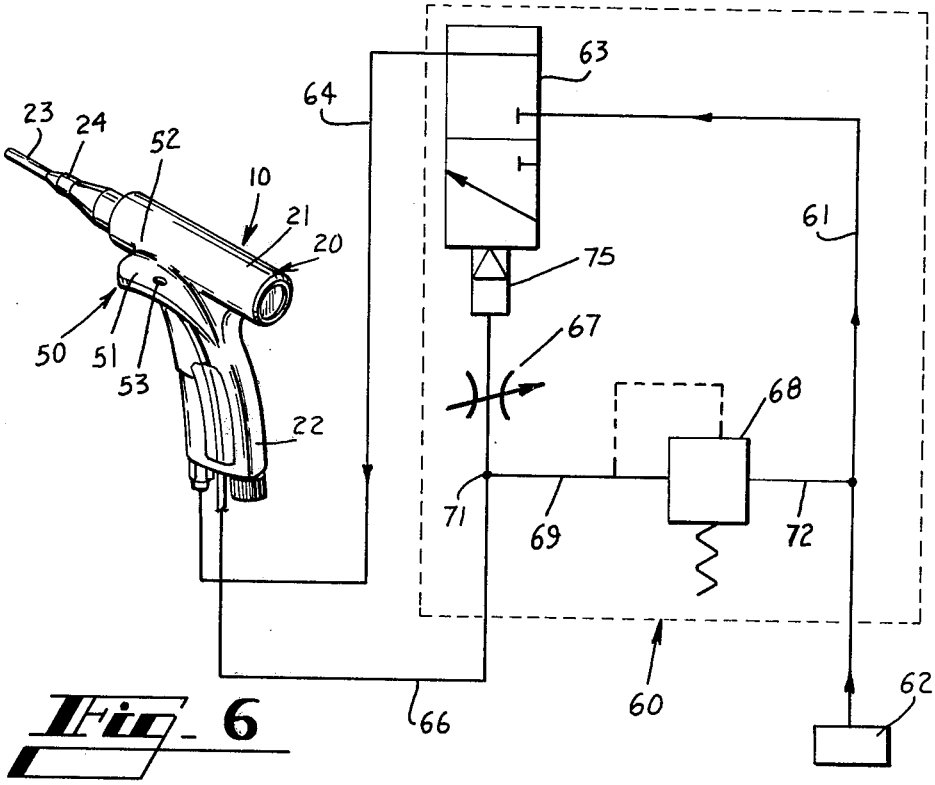
FIG. 6 is a perspective view of the tool of FIG. 1 that shows a thumb rest and a schematic view of a fluidic current which is controlled by the covering and uncovering of a port in the thumb rest to operate the tool.

In the tool 10 of this invention, there is provided a thumb rest 50 having a contoured surface 51. As can be seen in FIG. 6, the rest 50 has a convex curvature generally along a longitudinal axis of the barrel portion 21 and a concave curvature in a direction generally laterally of the barrel portion. The thumb rest 50 which is contoured to fit ninety-five percent of expected tool operators results in a much more improved power grip alignment. For those situations in which the standard rest 50 is not biomechanically suited to a particular worker, the rest may be modified in configuration. The thumb 36 is aligned in an improved musculoskeletal position with substantially less abduction movements of the distal end 37 of the thumb. The thumb 36 essentially is in a relaxed mode with respect to the palm of the hand with only a slight rolling or abduction movement being required to control the operation of the tool.

The contoured thumb rest 50 is made of plastic such as a molded polyester, for example, and as can best be seen in FIG. 6, the rest is attached to a side 52 of the housing 20 of the tool 10. A port 53 opens to the surface 51 of the rest and is connected to a fluidic logic circuit 60. In order to custom fit a tool 10 to a particular operator's hand, the port 53 can be relocated with respect to the surface 51 and that operator's thumb 36.

Advantageously, the rest 50 is configured and attached to the housing 20 of the tool 10 to facilitate a generally prehensile type grasp with a modified split first finger power hand grip (see FIG. 1). This provides an element of precision and allows the distal phalanx 37 of the thumb 36 to be adducted and flexed by relatively small adjustments of posture through the interphalangeal joint 40 (see FIG. 4) of the thumb. The thumb 36 effectively becomes a precision type element and results in less strain and activity for the metacarpolphalangeal joint 41 during use of the tool 10. The entire thumb 36 is aligned with the rest 50 and is essentially in a relaxed mode during a covering and uncovering cycle of the port 53.

Unlike at least one prior art arrangement, the tool 10 of this invention reduces the abduction and adduction of the thumb movement at the carpometacarpal joint in the hand. As a result, the muscle activity in the hand 30 will be reduced, particularly the abductor and flexor pollicis longus and the extensor pollicis longus and brevis muscles. Advantageously, the activity of the intrinsic muscles in the hand 30 is also reduced.

A fluidic logic circuit 60 (see again FIG. 6) for controlling the operation of the tool of this invention includes a flexible conduit 61 which extends from supply 62 of air at a pressure of about 7.03 kg/sq. cm to an air valve 63. The air valve 63 is connected through a conduit 64 to the tool 10.

In order to allow the control of the operation of the tool 10 by minimal movements of an operator's thumb, the circuit 60 includes a conduit 66 which connects the port 53 that opens to the surface 51 of the thumb rest 50 to a flow restrictor 67 and thence to the air valve. An air regulator 68 is connected by a line 69 to the line 66 at a junction point 71 and by a line 72 to the line 61.

In an unoperated condition, air at a pressure of about 7.03 kg/sq. cm is supplied along the line 61 to the air valve which is in a first state that prevents the flow through of the air to the tool 10. Air at about 7.03 kg/sq. cm. is also supplied along the line 72 to the regulator 68 which causes the air pressure to be reduced to a pressure in the range of about 2.1 to about $3.5\times10^{-1}$ kg/sq. cm. This low pressure air is passed out of the regulator 68 to the junction point 71 but because the port 53 is uncovered, the flow of air is through the port of the thumb rest 50 instead of through the flow restrictor 67 to the air valve.

When it is desired to operate the tool 10, the operator covers the port 53 which causes the restrictor to permit the passage of the low pressure air from the air regulator to the air valve. Entry of low pressure air into the air valve at input 75 causes the air valve to be switched to a second state to allow its passage of the 7.03 kg/sq. cm air along the flexible conduit 64 to the air motor of the tool 10.

As should be apparent from FIG. 1, the disposition of the thumb rest 50 with respect to the housing of the tool 10 results in a relaxed gripping of the tool by the operator. Even though the longitudinal axis of the tool 10 is at some angle to an axis of the forearm 27, to facilitate terminal selection for each cycle of wire wrapping, worker fatigue is avoided. The slight movement of the thumb 36 which is required to cover and to uncover the port 53 means that the entire thumb from its thenar eminence 43 to its distal tip 37 is stable as a unit with insignificant deviations at its joints. As a result, the carpometacarpal joint 42 in the thenar eminence 43 and the phalanges are not required to be moved substantially in a repetitive, fatiguing fashion throughout a work shift. Morever, the activity of particular muscles, such as the extensor and flexor pollicis longus and the extensor pollicis brevis muscles, flexor pollicis longus and flexor pollicis brevis and abductor pollicis longus and brevis muscles which are used to move the thumb is substantially reduced.

It is to be understood that the above-claimed arrangements are simply illustrative of the invention. Other arrangements may be devised by these skilled in the art which will embody the principles of the invention and fall within the spirit and scope thereof.

What is claimed is:

1. A hand-held tool, said tool comprising:

a housing which includes a handle portion having a grip formed on a forward end thereof and a barrel having a working portion, said barrel adapted to be held in a user's hand;

means for operating said working portion;

a rest separate from said grip disposed laterally of said working portion and connected to said handle portion, said rest having a surface which is sufficiently close to a user's thumb for supportively engaging the user's thumb when the user's fingers engage the grip and a port which opens to said surface, said surface being configured to allow the thumb to cover and to uncover said port in a repetitive manner with insubstantial movement of proximal and distal phalanges of the user's thumb; and means connected to said port and to said means for operating said working portion and responsive to the covering and to the uncovering of said port with the user's thumb for causing the operation and the discontinuance of the operation of said working portion of said tool.

2. The tool of claim 1, wherein said rest is configured to minimize muscular activity of a user's abductor pollicis longus and extensor pollicis brevis muscles during repetitive cycles of covering and uncovering said port.

3. A tool for wrapping a plurality of turns of a metallic conductor about a terminal, said tool comprising:

a housing which includes a handle portion having a grip formed on a forward end thereof and a barrel having a wire-wrapping portion, said wire-wrapping portion including an opening for receiving a terminal about which a wire is to be wrapped and means mounted for rotation within said housing for wrapping a plurality of turns of a wire about the terminal which extends into said opening of said wire wrapping portion, said barrel being adapted to be held in a user's hand;

a rest separate from said grip disposed laterally of said wire wrapping portion and connected to said handle portion said rest having a surface which is sufficiently close to a user's thumb for supportively engaging the user's thumb when the user's fingers engage the grip and a port which opens to said surface, said surface being configured to allow the thumb to cover and to uncover said port in a repetitive manner with insubstantial movement of proximal and distal phalanges of the thumb; and means connected to said port of said rest and to said means for wrapping and responsive to the covering and to the uncovering of said port with the user's thumb for causing said means for wrapping to be moved rotatably to wrap a plurality of turns of a wire about the terminal which is received in said opening of said wire-wrapping portion of said housing and for discontinuing the rotatable movement of said means for wrapping.

4. The tool of claim 3 wherein said rest is made of a plastic material which is molded to include a convex curvature extending in a direction generally along the axis of the housing and a concave curvature generally extending outwardly from said housing, wherein said port is covered and uncovered by relatively slight movement of the interphalangeal joint of the thumb of a user's hand.

5. The tool of claim 3, wherein said means connected to said port includes a fluidic circuit for controlling the operation of said tool in response to a covering and an uncovering of said port; and a conduit which is connected to said fluidic circuit and which communicates with said port, said fluidic circuit being effective when said port is covered for causing said wrapping portion to be turned and being effective when said port is uncovered for discontinuing the turning of said wrapping portion.

* * * * *